US007204198B2

(12) United States Patent
Anderson

(10) Patent No.: US 7,204,198 B2
(45) Date of Patent: Apr. 17, 2007

(54) METHODS AND APPARATUS TO REDUCE FORMATION OF STREAKS ON A WALL

(76) Inventor: Paul A. Anderson, 323 S. Bristol La., Arlington Heights, IL (US) 60004

( * ) Notice: Subject to any disclaimer, the term of this patent is extended or adjusted under 35 U.S.C. 154(b) by 0 days.

(21) Appl. No.: 10/836,678

(22) Filed: Apr. 30, 2004

(65) Prior Publication Data

US 2005/0241557 A1 Nov. 3, 2005

(51) Int. Cl.
*B63B 17/00* (2006.01)

(52) U.S. Cl. ..... 114/343; 114/361

(58) Field of Classification Search ..... 114/343, 114/361, 364, 218, 182, 183 R, 219, 382; 296/95.1; 52/58–62, 302.6
See application file for complete search history.

(56) References Cited

U.S. PATENT DOCUMENTS

| | | | | |
|---|---|---|---|---|
| 1,800,556 | A * | 4/1931 | Mead | 114/182 |
| 2,592,011 | A * | 4/1952 | Colston | 114/361 |
| 2,738,221 | A * | 3/1956 | Zwaska | 296/95.1 |
| 2,780,195 | A * | 2/1957 | Kiekhaefer | 114/382 |
| 4,862,822 | A * | 9/1989 | Michalowski | 114/364 |
| 6,164,231 | A * | 12/2000 | Shimmell et al. | 114/182 |
| 6,857,384 | B1 * | 2/2005 | Connor | 114/361 |

FOREIGN PATENT DOCUMENTS

JP 59114154 A * 7/1984

OTHER PUBLICATIONS

Color digital photographs of front and back of package for *Self-Adhesive V-Shaped Polypropylene Weatherstrip*, product sold by Ace Hardware Corporation (1998).
Color digital photographs of *Premium V-Flex Weatherstrip*, product sold by M-D Building Products, Inc., no date.
*RV Camping Campers Parts & Accessories*, prior art print-out from http://www.rainkap.com.
*Streak Getter Gutter Cleaner*, prior art print-out from http://www.gutterworks.com/streakgetter.html (printed Mar. 30, 2004).
*Drip Stop*, prior art print-out from http://www.fiamma.it/gb/products/comfort/drip.html (printed Mar. 30, 2004).

* cited by examiner

*Primary Examiner*—Ajay Vasudeva
(74) *Attorney, Agent, or Firm*—Hanley, Flight & Zimmerman, LLC

(57) ABSTRACT

Methods and apparatus to reduce formation of streaks from fluid running down a side surface of boat hull are disclosed. A disclosed method includes adhering a first portion of a flexible strip to the side surface of the hull, and employing a second portion of the flexible strip positioned at an obtuse angle to the first portion to deflect fluid running down the hull surface above the flexible strip away from the hull.

7 Claims, 2 Drawing Sheets

METHODS AND APPARATUS TO REDUCE FORMATION OF STREAKS ON A WALL

FIELD OF THE DISCLOSURE

This disclosure relates generally to streak and/or stain prevention, and, more particularly, to methods and apparatus to reduce formation of streaks from fluid running down a side surface of boat hull.

BACKGROUND

Many structures are subjected to rain water runoff and the like. Such run-off often causes streaking and staining which gives these structures a dirty, displeasing appearance. For example, boats frequently exhibit dark streaks along their hulls as a result of water running off of their decks. FIG. 1 illustrates this problem in further detail.

Turning to FIG. 1, a structure 10 (which may be, for example, a boat, a recreational vehicle, a recreational trailer or a building) includes an upper, drainage surface 12 and a plurality of walls 14. The drainage surface 12 may be generally horizontal (e.g., like a boat deck) or pitched (e.g., like a roof of a house). The walls 14 are generally positioned in a substantially vertical position, and may be substantially straight (e.g., like a wall of a typical building) or curved (like a hull of a typical boat), and/or may be stationary or mobile. As shown in the example of FIG. 1, it is often the case that one or more obstructions 16 are located along the edge joining the drainage surface 12 and the wall(s) 14. Such obstructions may concentrate the flow of the draining fluid in one or more areas of the wall(s) 14. As a result, dark streaks 18 form along the wall(s) 14. For example, a perforated toe rail on a boat tends to concentrate drainage through the perforations of the rail. This concentrated drainage creates unsightly streaks 18 along the hull beneath the perforations. Even in the absence of such obstructions (e.g., a non-perforated toe rail) where run-off is more dispersed, streaks still appear. Run-off streaks 18 are particularly visible against a light surface.

Attempts have been made to address this streaking problem in various contexts. For example, chemical cleaners have been made commercially available to remove such streaks 18 from rain gutters on buildings such as residential homes, and from the hulls of boats. In the recreational vehicle context, a recreational vehicle accessory has been marketed on the Internet which is intended to prevent black streaking on a recreational vehicle. The noted recreational accessory is structured to mount in a channel provided for a trim insert and appears to be substantially rigid.

DETAILED DESCRIPTION

Figure 1:
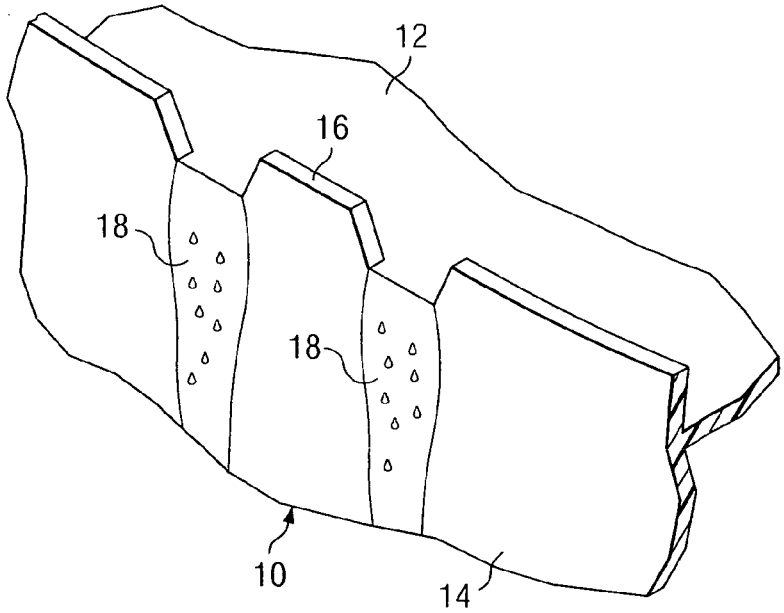
FIG. 1 (PRIOR ART)
FIG. 1 is a schematic illustration of an example prior art structure experiencing streaking due to run-off.
Figure 2:
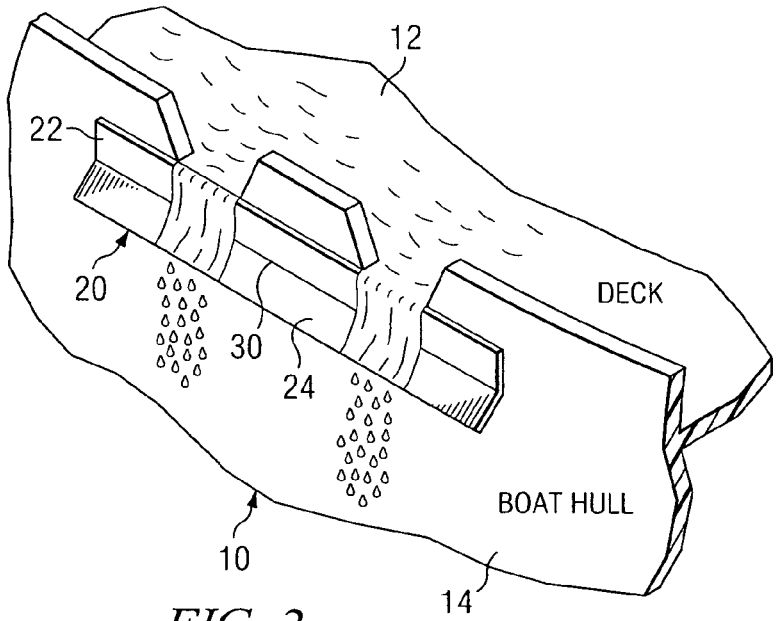
FIG. 2 illustrates an example baffle applied to the structure of FIG. 1 to reduce or prevent streaking.

FIG. 2 illustrates an example baffle 20 applied to the structure 10 of FIG. 1 to reduce or prevent streaking due to run-off of fluids. The structure 10 may be an indoor structure or an outdoor structure. In the illustrated example, the baffle 20 is adhered to the wall 14 of the structure 10 immediately adjacent the upper edge of the wall 14 in a generally horizontal orientation. Persons of ordinary skill in the art will appreciate, however, that other positions and/or orientations are likewise appropriate.

As shown in FIG. 2, the example baffle 20 is a flexible plastic strip that includes a first portion 22 which is secured to the wall 14 of the structure 10 via a pressure adhesive and a second portion 24 depending from the first portion. The second portion 24 is not directly secured to the wall 14, but is suspended by the first portion 22 at an obtuse angle to the first portion 22. As a result, water and/or other fluids running off of the drainage surface 12 run down the outer face of the first portion 22 of the baffle 20 and are then diverted along the surface of the second portion 24 of the baffle 20 and away from the wall 14. Because the run-off fluid is diverted away from the wall 14, the run-off fluid falls free of the structure 10 without forming streaks on the wall 14 beneath the baffle 20. As a result, the occurrence of unsightly streaks along the portion of the wall 14 beneath the baffle 20 is reduced or prevented.

Figure 3:
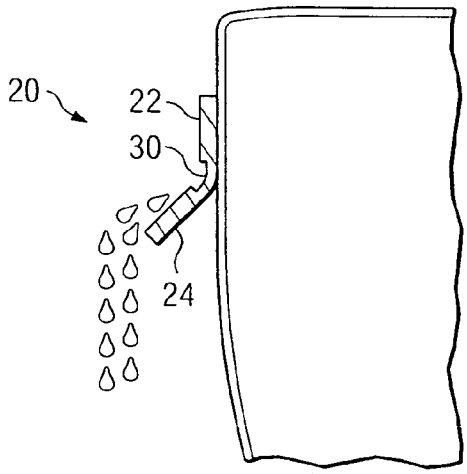
FIG. 3 is a side schematic view of the example baffle of FIG. 2.

An example baffle 20 is shown in greater detail in FIG. 3. In the example of FIG. 3, the first portion 22 and the second portion 24 of the baffle 20 have substantially the same size. In particular, each portion 22, 24 is about 0.5 inches wide and 0.015 inches thick. Preferably, the thickness of at least the portion of the baffle 20 to be adhered to the wall 14 is selected to be quite thin (e.g., on the order of 0.1 inches or less) such that fluid flows substantially uninterrupted from the surface of the wall 14 above the baffle 20 onto the face of the baffle 20 substantially as if the portion 22 and the wall 14 were coplanar. The length of the portions 22, 24 are preferably identical. However, persons of ordinary skill in the art will appreciate that these dimensions are given by way of examples, and that other dimensions may alternatively be selected. In particular, the dimensions should be selected to suit the desired application.

A chemical adhesive 28 is located on the rear surface of the first portion 22 of the baffle 20. The chemical adhesive 28 may be covered by a disposable backing such as a plastic or paper strip during transport and prior to application of the baffle 20 to the structure 10 to be serviced. The backing may be peeled away to expose the chemical adhesive 28 when it is desired to mount the baffle 20 to the structure 10 to be protected against streaking.

In the illustrated example, the first and second portions 22, 24 of the baffle 20 are integrally formed (e.g., molded or otherwise formed) at a predetermined obtuse angle. For example, the baffle 20 may be implemented using sheet stock. In an alternative embodiment, the first and second portions 22, 24 are joined by a living hinge 30. Integrally forming the first and second portions is presently preferred to the living hinge approach because the formed approach is believed to exhibit longer lasting resilience than the living hinge, while still remaining flexible. If the living hinge approach is followed, over time the living hinge 30 may lose its resiliency. If this occurs, the desired shape may be restored by hand.

Figure 4:
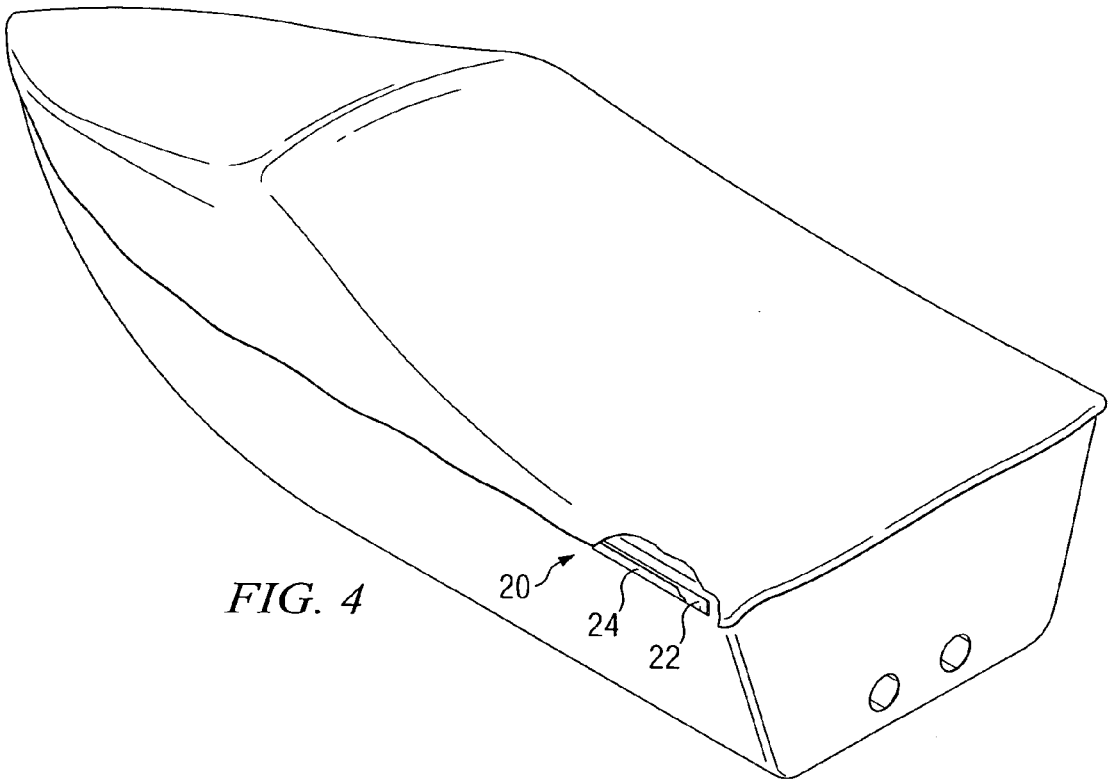
FIG. 4 is a perspective view of an example boat and cover, with a cut away section showing the baffle deflected by the cover.

Seamlessly joining the first and second portions 22, 24 (e.g., by molding them together) is preferred because the seamless joint prevents leakage between the first and second portions 22, 24 and because it permits the second portion 24 to flex relative to the first portion upon impact with other structures without breaking. In particular, in many applications, (e.g., in the boating context where the baffle 20 is applied to the exterior of a boat hull beneath, for example, a toe rail), the baffle 20 is positioned in places where it is likely to be impacted by other structures. For example, in the boat example, the baffle 20 may periodically strike against a dock, the hull of another boat, or even be compressed between the hull and a cover/tarp drawn around the hull and over the deck of the boat (See FIG. 4). Because of these possible impacts, it is desirable that the baffle 20 be resiliently flexible such that it will bend or otherwise deform without breaking (e.g., the first and/or second portions 22, 24 will move relative to one another such that the angle therebetween temporarily increases or decreases) when subjected to an impacting force, and such that the baffle 20 will return to a shape wherein the second portion 24 is disposed at an obtuse angle relative to the first portion 22 to deflect run-off away from the hull (as shown, for example, in FIG. 2) when the impacting force is removed.

In an example, the baffle 20 is implemented by the self-adhesive, V-shaped weather-stripping tape such as that sold by M-D Building Products, Inc. of Oklahoma City, Okla. under the product name "V-Flex Weather-Stripping," or by the self-adhesive, V-shaped, polypropylene weather-strip sold by Ace Hardware of Oak Brook, Ill. In such products, a plastic tape is creased or scored along its middle to form two generally equal portions 22, 24 joined by a living hinge 30. The living hinge 30 may be folded to position the second portion 24 at an obtuse angle relative to the first portion 22 and vice versa as shown, for example, in FIG. 3. One of the portions 22 is coated with a chemical adhesive covered by a removable, paper or plastic backing. These products may be repurposed to form the baffle 20 described above thereby providing a solution to the streaking problem noted above.

The above-described baffle 20 and variants thereof may be employed by (1) cleaning the surface 14 to be serviced by the baffle 20, (2) cutting the baffle 20 to one or more lengths corresponding to the area(s) to be protected from streaking, and then, (3) for each such area, (a) folding the baffle 20 such that the second portion 24 of the baffle is positioned at an obtuse angle to the first portion 22 (of course, in the case of a baffle 20 formed with the first and second portions 22 positioned at a predetermined obtuse angle, the folding process is unnecessary), (b) removing the backing from the first portion 22 of the baffle to expose the chemical adhesive 28, and (c) adhering the first portion of the baffle 20 to the wall 14 to be serviced by pressing the adhesive 28 against the wall 14 in the desired location and orientation such that fluid running down the wall 14 (e.g., from the drainage area 12) will be deflected away from the wall 14 by the baffle 20. Typically, it is desirable to position the baffle 20 in a generally horizontal orientation adjacent the upper edge of the wall 14 to be protected against streaking from fluid running down the wall to ensure fluid such as rain water is deflected away from the wall as high on the wall as possible and to reduce the incidence of fluid running along the length of the baffle 20.

The above disclosed methods and apparatus may be applied in many contexts to reduce or prevent the formation of streaks due to run-off and the like. For example, in boating, precipitation from splash and/or from rain and/or heavy dew often collects on the deck and other top surfaces of a boat. This water typically runs off the upper surfaces of the boat by passing under or through a toe rail. In the case of a perforated toe rail, the run-off water is concentrated to pass through the perforations and, thus, streaks form beneath the perforations along the sides of the hull. In the case of a non-perforated toe rail, the water is more dispersed, but streaks still form. As mentioned above, boat owners frequently use marine chemicals to remove these streaks. However, the need for such cleaning can be reduced or eliminated by mounting the baffle 20 on the hull beneath and adjacent the toe rail (e.g., along the entire length of the hull or at least under any perforations formed in the toe rail and/or any scuppers/drains) to deflect run-off away from the hull. Of course, one baffle 20 may be used or multiple baffles 20 may be used to service a wall 14.

In another example application, the above disclosed methods and apparatus may be applied to a recreational vehicle or trailer. In such contexts, the baffle 20 may be mounted to the topmost edges of the sides of the recreational trailer or vehicle to deflect run-off from the top of the vehicle/trailer away from the sides of the same.

In another context, the above disclosed methods and apparatus may be applied to reduce or prevent streaks from forming along rain gutters due to overflow or the like. For example, the outer horizontal flange of a rain gutter often collects rain water which runs down the curved outside face of the gutter, thereby creating streaks. When applied along the upper outside edge of the gutter, the baffle 20 will deflect the water away from the curved outer face of the gutter thereby preventing or reducing streaks.

In still another example application, the above disclosed methods and apparatus may be applied to reduce or prevent streaks from forming on signs. For example, the baffle 20 may be mounted along the upper edge of the front face of a road sign (e.g., a stop sign) or advertisement (e.g., a billboard) to deflect rain water and the like away from the sign to thereby reduce streaking.

In yet another application, the above disclosed methods and apparatus may be applied to reduce or prevent chemical surface finishes such as paint, stain or varnish from streaking down the side of a surface during or after application of the same. For instance, a painter might wish to apply the baffle 20 to a wall to be painted such that paint applied above the baffle is deflected away from the wall (e.g., onto drop clothes below) by the baffle rather then streaking down the wall.

In another application, the baffle 20 may be mounted upside down relative to the position shown in FIG. 2, such that fluid running down a wall 14 is captured and directed by an acute-angle channel formed between the wall 14 and the back of the second portion 24.

In applications where the baffle 20 is intended for permanent placement, its color is preferably selected to blend into the wall 14 it protects. For example, a white baffle 20 may be used with the white hull of a boat. Alternatively, the baffle 20 may be colorless or clear. For example, the baffle 20 may be formed of transparent plastic that is ultra-violet (UV) protected against discoloration.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method to reduce formation of streaks caused by fluid running down a surface of a boat hull, comprising:

adhering a first portion of a flexible strip to a side surface of a boat hull; and employing a second portion of the flexible strip to deflect fluid running down a portion of the surface located above the flexible strip away from the surface, wherein the second portion is disposed at an obtuse angle relative to the portion of the surface located above the flexible strip, wherein the first portion and the second portion of the flexible strip are joined by a living hinge, and wherein the living hinge has a thickness that is substantially less than the respective thickness of the first portion and the second portion of the flexible strip.

2. The method defined in claim 1 wherein adhering the first portion of the flexible strip to the surface comprises removing a backing material to expose a chemical adhesive on the first portion of the strip.

3. The method defined in claim 1 wherein adhering the first portion of the flexible strip to the surface comprises positioning the flexible strip in a generally horizontal position.

4. The method defined in claim 1 wherein the first portion and the second portion of the flexible strip are integrally formed at an obtuse angle.

5. The method defined in claim 1 wherein the flexible strip comprises weather-stripping tape.

6. The method defined in claim 1 wherein adhering the first portion of the flexible strip to the surface comprises adhering the first portion along substantially an upper edge of the surface.

7. The method defined in claim 1 wherein a color of the flexible strip is selected to substantially match a color of the surface.

* * * * *